United States Patent [19]

Fujiwara et al.

[11] Patent Number: 4,467,536

[45] Date of Patent: Aug. 28, 1984

[54] CANVAS ROLL ARRANGEMENT

[75] Inventors: Haruyoshi Fujiwara; Yuji Kadota, both of Mihara, Japan

[73] Assignee: Mitsubishi Jukogyo Kabushiki Kaisha, Tokyo, Japan

[21] Appl. No.: 482,917

[22] Filed: Apr. 7, 1983

Related U.S. Application Data

[63] Continuation of Ser. No. 250,872, Apr. 3, 1981, abandoned.

[30] Foreign Application Priority Data

Apr. 10, 1980 [JP] Japan ..... 55-48721

[51] Int. Cl.[3] ..... F26B 13/08

[52] U.S. Cl. ..... 34/116; 34/123

[58] Field of Search ..... 34/116, 117, 123

[56] References Cited

FOREIGN PATENT DOCUMENTS 991741 10/1951 France ..... 34/116

*Primary Examiner*—Larry I. Schwartz

*Attorney, Agent, or Firm*—Murray Schaffer

[57] ABSTRACT

A roller arrangement for the dryer section of a multi-cylinder paper machine wherein two carrier belts are entrained, applied to each other to form a chimney through which air drafts pass. A seal roll is disposed between the runs of the belts to be driven by contact with one belt, while providing a slight gap between it and the other belt which moves in the same direction, so that a flow of air counter to the draft is created.

3 Claims, 3 Drawing Figures

CANVAS ROLL ARRANGEMENT

This is a continuation of Ser. No. 250,872, filed Apr. 3, 1981, now abandoned.

BACKGROUND OF THE INVENTION

This invention relates to a roller guide arrangement for the canvas or dry felt belts in a multicylinder type dryer section of a paper machine.

Generally, in a conventional arrangement, a freshly formed paper sheet is passed sequentially between one or more endless belts of canvas or felt, and cylindrical dryers. The belts and dryers are combined into a plurality of groups so that the paper can pass from cylinder to cylinder and the belts can be separated for their own drying and cleaning.

FIGS. 1 and 2 show schematically a multi grouped-multi-cylinder dryer system of conventional arrangement in paper making machines. The cylinders 1, 1*a* . . . 1*e* are grouped into four groups, namely an upper front group $G_1$, a bottom front group $G_2$, upper rear group $G_3$ and a bottom rear group $G_4$. The groups are provided with an endless, continuously moving drying belt of canvas or felt, 4, 5, 6 and 7 respectively, which are driven and directed by rollers 2, $2_1$ . . . $2_n$. A freshly formed paper sheet is passed into the bottom preceding groups $G_1$ between the belt 4 and the cylinder 1, and passes from cylinder to cylinder, being carried by the entrained succession of belts. Generally, the separated runs, or return runs of the bottom belts 4 and 7, being spaced from each other, form a chimney effect through which space an air draft X from below eg: basement, enters.

In either figure, if the upward air current or draft X from the basement below is excessively large in a zone A, flapping will occur in zones C and D, through which only the paper sheet passes, indicated by chain lines, causing trouble during high speed operation.

To minimize the draft X, therefore, a seal zone B usually is formed by the roller 2 and the belts 4, 7. FIG. 1 illustrates a point seal established by the roller 2 and the belt 7 at one point (actually the seal is linear because the arrangement has a depth at right angles to the plane of the drawing, the same applying hereinafter). FIG. 2 illustrates a linear seal formed by the belts 4 and 7 (actually the seal is planar for the reason explained above, the same applying hereinafter).

In either case, the seal zone B constitutes a major obstacle in the path of the broke that will result from a break in the sheet passing around the particular dryer, which will be dropped off and accumulate in the zone A. The broke cannot fall through the seal zone, thus unfavorably affecting the operational efficiency.

The present invention has as its object the elimination of the foregoing obstacle. The invention contemplates the provision of a roller arrangement which can strikingly enhance the operational efficiency, while maintaining about the same degree of sealability as by the conventional arrangements. This is effected by the introduction of a seal roll into the space or chimney between return run sections of the felts.

SUMMARY OF THE INVENTION

In accordance with the invention, a roller arrangement for the dryer section of a multicylinder paper machine is provided which comprises a sealing roll disposed between the belt runs leading from the front and to the rear dryer groups. The seal roll is adapted to be driven by contact with the rear group dryer belt while providing a slight gap between it and the front group belt.

According to the present invention, the seal roll disposed between the return runs of belts exiting and entering front and rear dryer groups respectively and slightly spaced away from the front group belt and driven in contact with the rear group belt, has the advantage that it is made to rotate anticlockwise or in the same direction as the opposed front group belt that runs downwardly, and therefore the upward draft is offset and significantly minimized. Also, the accumulation of broke that has resulted from a break is caused to fall onto the seal roll, and thence further downward, without human assistance, through the gap between the seal roll and the front group belt. Because the seal roll is rotated in contact with the rear group canvas, i.e., anticlockwise or downwardly on the side facing the downwardly running front group canvas, the descent of the broke and its expulsion is facilitated. Consequently, the invention remarkably improves the disposal of the broke in every case of break over the conventional arrangements and thereby strikingly enhances the operational efficiency of the paper machine.

The above and other objects, features, and advantages of the invention will become more apparent from the following detailed description taken in conjunction with the accompanying drawings.

BRIEF DESCRIPTION OF THE DRAWINGS

Figure 1:
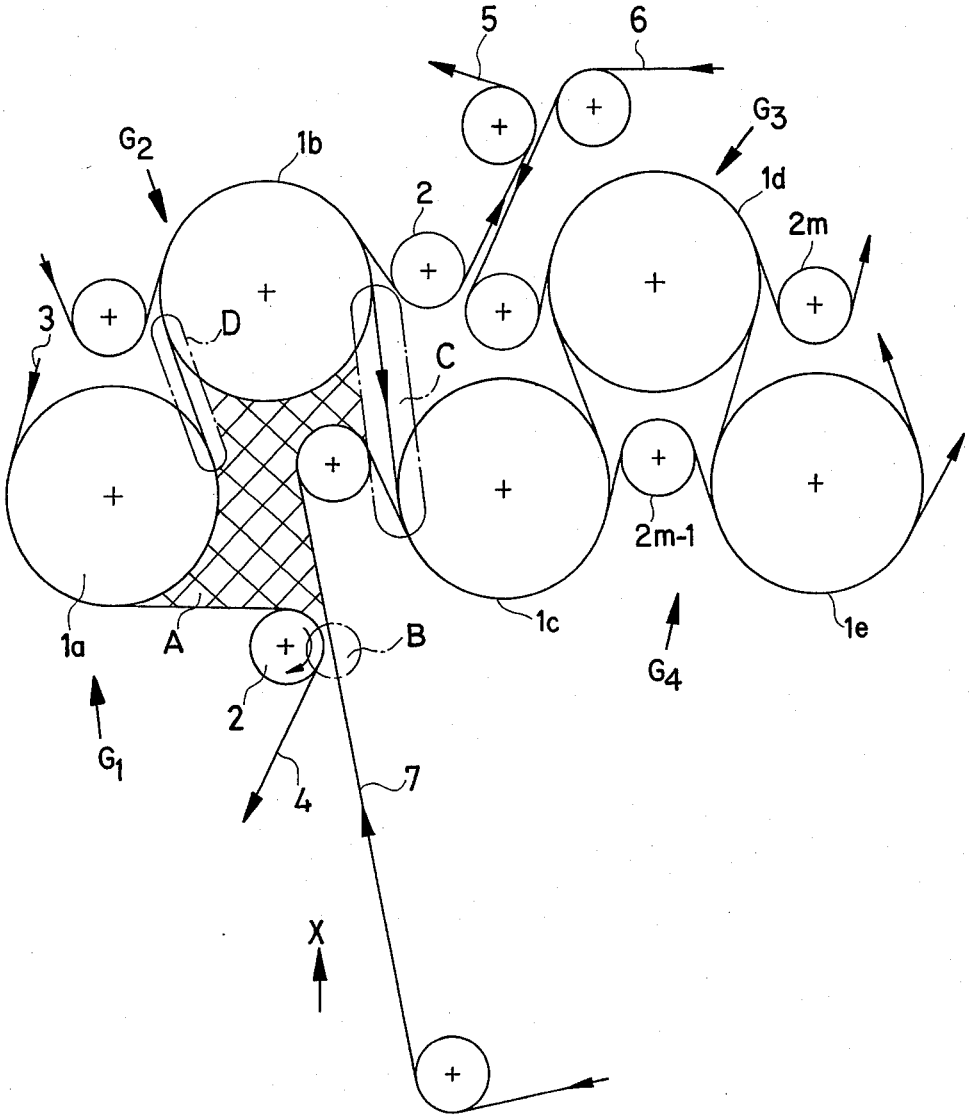
PRIOR ART FIG.1
Figure 2:
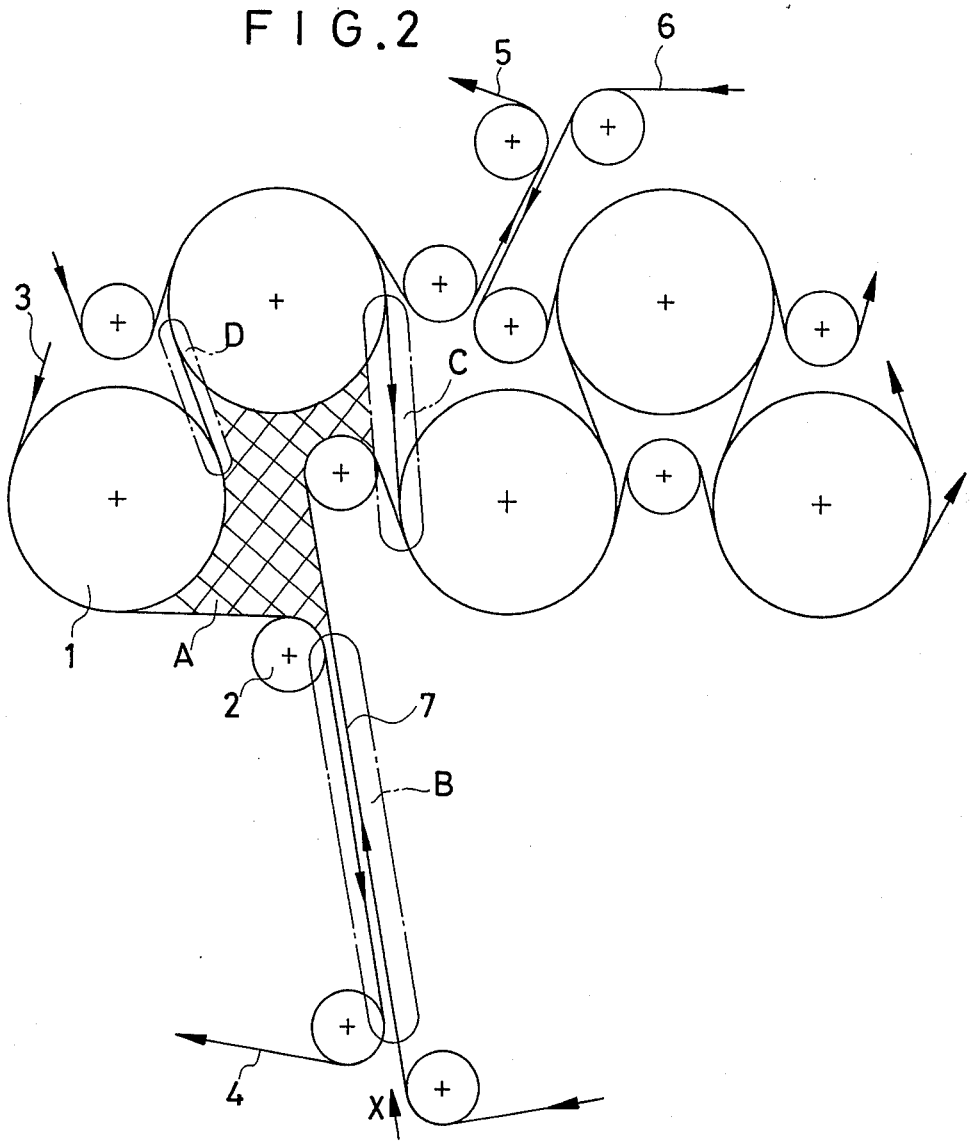
PRIOR ART FIG.2
Figure 3:
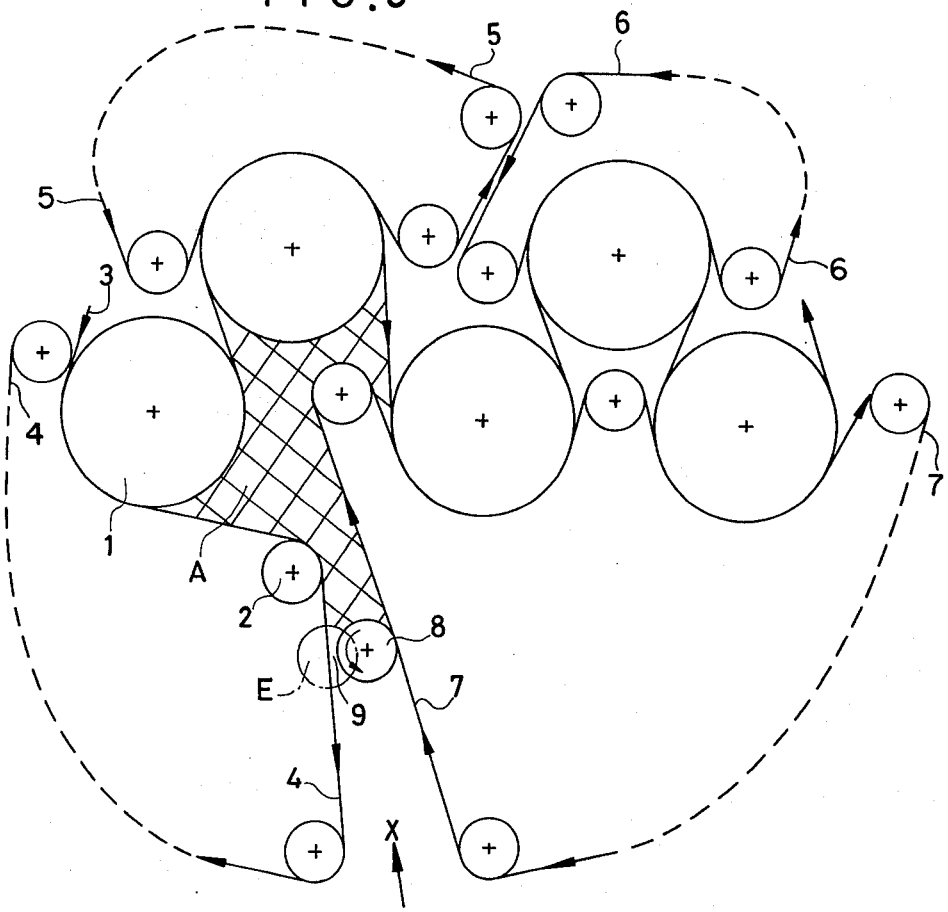

IN THE DRAWINGS:

FIG. 1 is a schematic view of a typical roll arrangement in the dryer part of a conventional paper machine;

FIG. 2 is a schematic view of another typical arrangement of another conventional machine; and FIG. 3 is a schematic view of a canvas roll arrangement embodying the present invention.

DESCRIPTION OF THE INVENTION

An embodiment of the invention will now be described with reference to FIG. 3, in which like or similar parts to those in the conventional arrangements already explained are designated by like numerals or symbols. In FIG. 3, there are shown a dryer having drying cylinder 1 . . . 1*e* belt, rolls 2 . . . 2*n*, paper sheet 3, and belts 4, 5, 6, 7, all arranged in the same manner as in the conventional layouts shown in FIGS. 1 and 2.

This invention is characterized in that a seal roll 8 is disposed between the belts 4 and 7 and is held in contact with the latter belt in the lower portion of the rear dryer group, so that the seal roll 8 is driven by the belt 7, while being kept a slight distance 9 away from the lower belt 4 of the front dryer group. The seal between the belts 4 and 7 against the ascending draft X from the basement below is provided in a region E, in the form of a point seal between the seal roll 8 and the belt 4 in the lower portion of the front group. The seal roll 8 itself may be identical in construction with roll 2.

The operation of the arrangement will now be explained. In the seal zone E, the belt 4 and the seal roll 8 are running and rotating in the same direction (downwardly or anticlockwise). Since the both motions are counter to the flow of the upward draft X from the basement, the streams of air accompanying the running belt 4 and seal roll 8 coact to offset the draft X. This enables the zone E to achieve better seal against the draft from the basement than the point seal of FIG. 1. In case of a break in the paper sheet, the broke dropping off in the region A readily falls onto the seal roll 8 because the gap or chimney between the belts 4 and 7 is maintained wide sufficiently by the same roll. At this point, the seal roll 8 and the lower run of belt 4 of the front dryer group are both rotating or running in the same direction, downward or anticlockwise, and naturally the accumulation of the broke that has fallen into the region E is then forced by the seal roll 8 and the lower run of the belt 4 into the basement, easily passing through the neck E.

We claim:

1. In a multi-cylinder dryer section of a paper making machine having a plurality of carrier belts adapted to press a paper web against at least one drying cylinder, at least one pair of said carrier belts is entrained to move in opposition to each other and define a space through which air drafts may pass, an arrangement for minimizing the passage of air drafts through said space comprising a roller disposed between said belts in contact with one of said belts to be driven thereby, said roller being spaced from the other belt and having a diameter that substantially occludes the width of said space but leaves a defined clearance between confronting portions of said other belt and the periphery of said roller, said roller and said other belt being driven in a direction coacting to produce a flow of air contrary to the direction of air draft flow to seal said defined clearance and impede the passage of air drafts through said space.

2. The arrangement according to claim 1 wherein portions of said opposed pair of belts are arranged substantially vertical and said roller contacts said one belt to be driven or in an upward direction and to coact with the downward movement of said other belt to prevent an upward draft from passage through said defined clearance.

3. The arrangement according to claim 1 wherein said clearance is dimensioned to permit passage of paper debris therethrough.

* * * * *